US006056618A

United States Patent [19]

Larian

[11] Patent Number: 6,056,618

[45] Date of Patent: May 2, 2000

[54] TOY CHARACTER WITH ELECTRONIC ACTIVITIES-ORIENTED GAME UNIT

[76] Inventor: Isaac Larian, 237 Carolwood, Los Angeles, Calif. 90077

[21] Appl. No.: 09/084,798

[22] Filed: May 26, 1998

[51] Int. Cl.[7] ..... A63H 3/00

[52] U.S. Cl. ..... 446/73; 446/72; 446/268; 446/490

[58] Field of Search ..... 446/71, 72, 73, 446/75, 77, 81, 268, 295, 296, 318, 369, 490

[56] References Cited

U.S. PATENT DOCUMENTS

| | | | |
|---|---|---|---|
| D. 226,101 | 1/1973 | Marcus | 446/268 |
| D. 347,655 | 6/1994 | Munro | 446/268 |
| 1,565,145 | 12/1925 | Henry . | |
| 1,756,048 | 4/1930 | Williams . | |
| 2,619,771 | 12/1952 | Jones . | |
| 2,995,865 | 8/1961 | Kiscadden . | |
| 3,977,292 | 8/1976 | Favilli et al. | 84/470 |
| 4,237,647 | 12/1980 | Shaw | 46/117 |
| 4,249,338 | 2/1981 | Wexler | 46/232 |
| 4,451,911 | 5/1984 | Klose et al. | 369/31 |
| 4,456,384 | 6/1984 | Murakami | 446/73 |
| 4,516,950 | 5/1985 | Berman et al. | 446/297 |
| 4,571,199 | 2/1986 | Murakami | 446/73 |
| 4,645,470 | 2/1987 | Benton | 446/73 |
| 4,659,919 | 4/1987 | Price | 250/209 |
| 4,675,519 | 6/1987 | Price | 250/209 |
| 4,687,457 | 8/1987 | Milner | 446/175 |
| 4,695,264 | 9/1987 | McLeod, Jr. | 446/369 |
| 4,715,840 | 12/1987 | Swift | 446/74 |
| 4,820,236 | 4/1989 | Berliner et al. | 446/369 |
| 4,840,602 | 6/1989 | Rose | 446/175 |
| 4,857,030 | 8/1989 | Rose | 446/303 |
| 5,000,171 | 3/1991 | Hofer | 446/73 |
| 5,011,449 | 4/1991 | Handy et al. | 446/297 |
| 5,059,149 | 10/1991 | Stone | 446/73 |
| 5,073,140 | 12/1991 | Lebensfeld et al. | 446/268 |
| 5,147,237 | 9/1992 | Kwan et al. | 446/297 |
| 5,267,886 | 12/1993 | Wood et al. | 446/175 |
| 5,279,514 | 1/1994 | Lacombe et al. | 446/297 |
| 5,281,180 | 1/1994 | Lam et al. | 446/268 |
| 5,326,300 | 7/1994 | Sonders | 446/73 |
| 5,344,355 | 9/1994 | Silverstein | 446/72 |
| 5,374,192 | 12/1994 | Marble et al. | 434/236 |
| 5,376,038 | 12/1994 | Arad et al. | 446/297 |
| 5,393,257 | 2/1995 | Spector | 446/27 |
| 5,433,643 | 7/1995 | Pratt | 446/73 |
| 5,501,627 | 3/1996 | Ekstein | 446/175 |
| 5,547,412 | 8/1996 | Wilcox | 446/81 X |
| 5,607,337 | 3/1997 | Callahan | 446/268 X |
| 5,836,801 | 11/1998 | Lin | 446/490 X |

*Primary Examiner*—Sam Rimell

*Attorney, Agent, or Firm*—Oppenheimer Wolff & Donnelly LLP

[57] ABSTRACT

A toy apparatus including a toy character and a game unit that is detachably secured to the toy character. The game unit is sized to fit into a receptacle of the toy character and includes a visual display. The game unit is programmed to display a virtual toy character corresponding to the toy character and to display a sequence of visual displays embodying a time-dependent interactive game pertaining to the virtual toy character.

17 Claims, 6 Drawing Sheets

FIG. 5
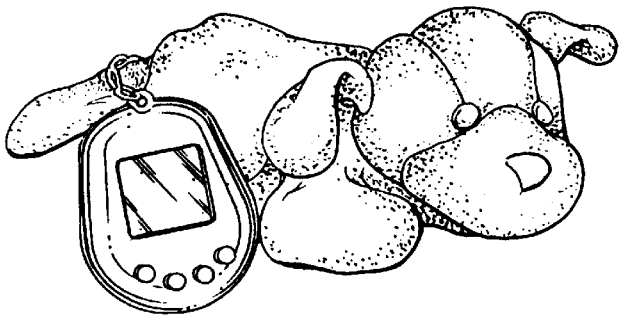
FIG. 6
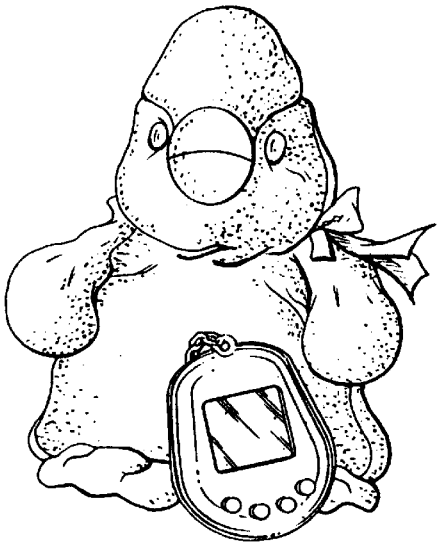
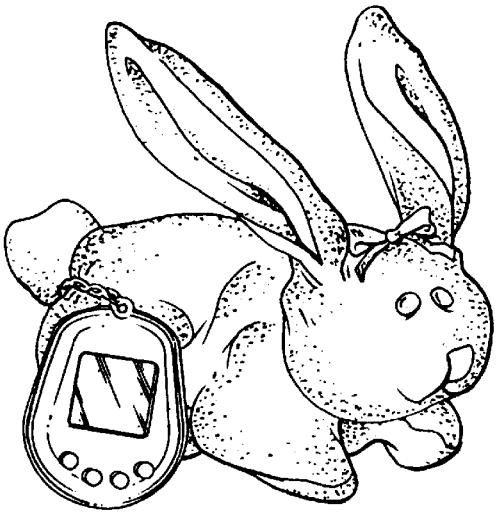
FIG. 7
FIG. 8
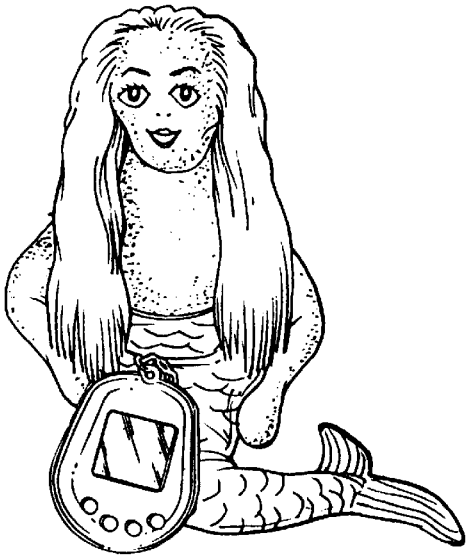
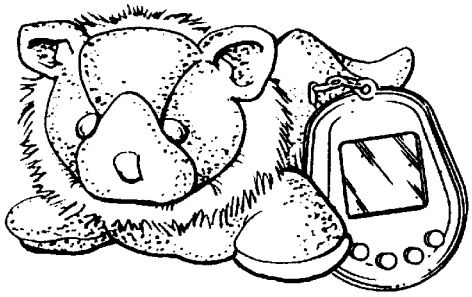
FIG. 9

TOY CHARACTER WITH ELECTRONIC ACTIVITIES-ORIENTED GAME UNIT

BACKGROUND OF THE INVENTION

1. Field of the Invention

The present invention relates to a toy character with a pocket sized to receive an electronic game unit and, more particularly, pertains to a toy character with an electronic activities-oriented game unit that is detachably secured to the toy character and sized to fit within a sealable pouch formed on the outside of the toy character.

2 . Description of the Related Art

A variety of toy characters and electronic games are known. However, the art is devoid of a toy character with an electronic activities-oriented game unit that is detachably secured to the toy character and sized to fit into a receptacle of the toy character, wherein the game unit includes a visual display and is programmed to display a virtual toy character corresponding to the toy character and to display a sequence of visual displays embodying a time-dependent interactive game pertaining to the virtual toy character.

OBJECTS AND SUMMARY OF THE INVENTION

Thus, it is an object of the present invention to provide a toy character with an electronic game unit that is secured or detachably secured to the toy character.

Another object is to provide a toy character with an electronic game unit that is sized to fit into a receptacle of the toy character.

Another object is to provide a toy character wherein the game unit includes a visual display.

Another object is to provide a toy character wherein the game unit is programmed to display a virtual toy character corresponding to the toy character.

Another object is to provide a toy character wherein the game unit is programmed to display a sequence of visual displays embodying an interactive game pertaining to the virtual toy character.

Another object is to provide a toy character wherein the interactive game is time-dependent.

In accordance with a specific illustrative embodiment of the present invention, a toy apparatus includes: a toy character including a pouch with a sealable opening; an activities-oriented game unit programmed to display images to a player of the game unit with the game unit being sized to fit within the pouch; and a mechanism for detachably securing the game unit to the toy character.

In another aspect of the present invention, the game unit is programmed to generate visible images of a virtual toy character corresponding to the toy character.

In another aspect of the present invention, the game unit includes a visual display at which the visible image is presented to a player of the game unit and the game unit is programmed to display icons at the visual display.

In another aspect of the present invention, the game wait includes player input mechanisms configured to facilitate a selection of one of the icons by the player.

In another aspect of the present invention, at least one of the icons is an activity icon providing a visual representation of an activity, and the game unit is programmed to provide, in response to a selection of the activity icon, an interactive interface at the visual display prompting the player to participate in the activity with the virtual toy character.

In another aspect of the present invention, at least one of the icons is a status icon, and the game unit is programmed to provide a visual indication at the visual display of a status of an attribute of the virtual toy character.

In another aspect of the present invention, a toy apparatus includes: a toy character with a receptacle; an activities-oriented game unit programmed to provide images of the toy character to a player of the game unit with the game unit being sized to fit within the receptacle; and a tether adapted to secure the game unit to the toy character.

In another aspect of the present invention, a toy apparatus includes: a toy character; and a game unit including a visual display, the game unit being programmed to display images pertaining to the toy character on the visual display.

In another aspect of the present invention, the toy apparatus further includes a securing mechanism such as a latch for securing the game unit to the toy character.

DESCRIPTION OF THE DRAWINGS

Other objects, features and advantages of the invention will become readily apparent upon reference to the following detailed description when considered in conjunction with the accompanying drawings, in which like reference numerals designate like parts throughout the figures thereof, and wherein:

FIG. 5 is an alternative preferred embodiment of the present invention wherein the toy character is a dog and, more particularly, a puppy;

FIG. 6 is an alternative preferred embodiment of the present invention wherein the toy character is a penguin;

FIG. 7 is an alternative preferred embodiment of the present invention wherein the toy character is a rabbit;

FIG. 8 is an alternative preferred embodiment of the present invention wherein the toy character is a mermaid; and FIG. 9 is an alternative preferred embodiment of the present invention wherein the toy character is a cat and, more particularly, a kitten.

DETAILED DESCRIPTION OF THE PREFERRED EMBODIMENTS

Figure 2:
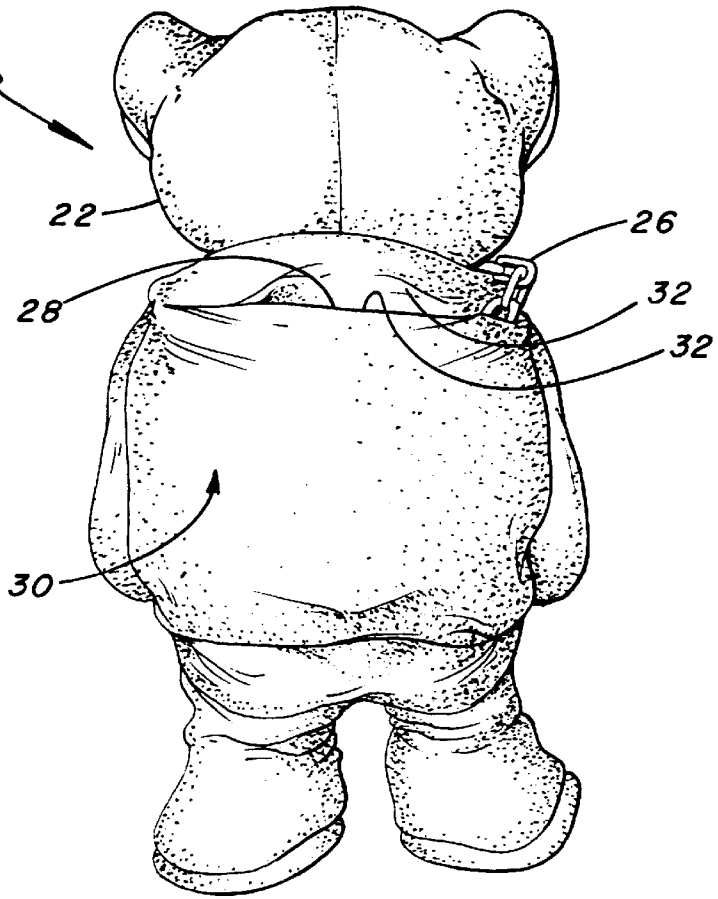
FIG. 2 is a rear view of the toy character of FIG. 1 with the electronic activities-oriented game unit secured within a pouch formed on back side of the toy character.
Figure 1:
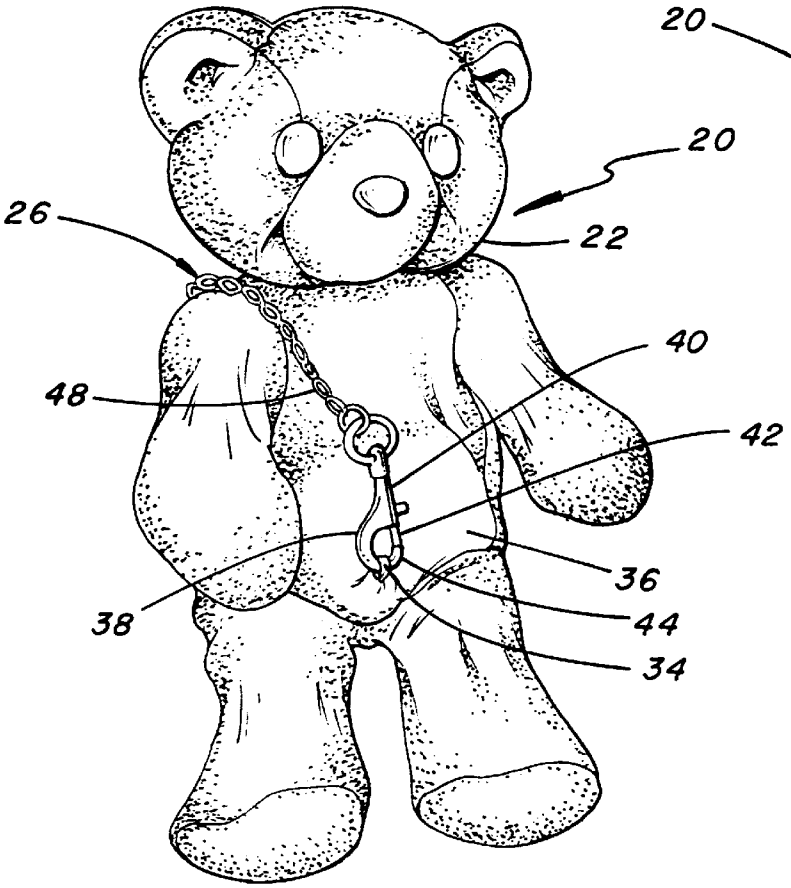
FIG. 1 is a front view of an exemplary preferred embodiment of a bear toy character with an electronic activities-oriented game unit according to the present invention.
Figure 3:
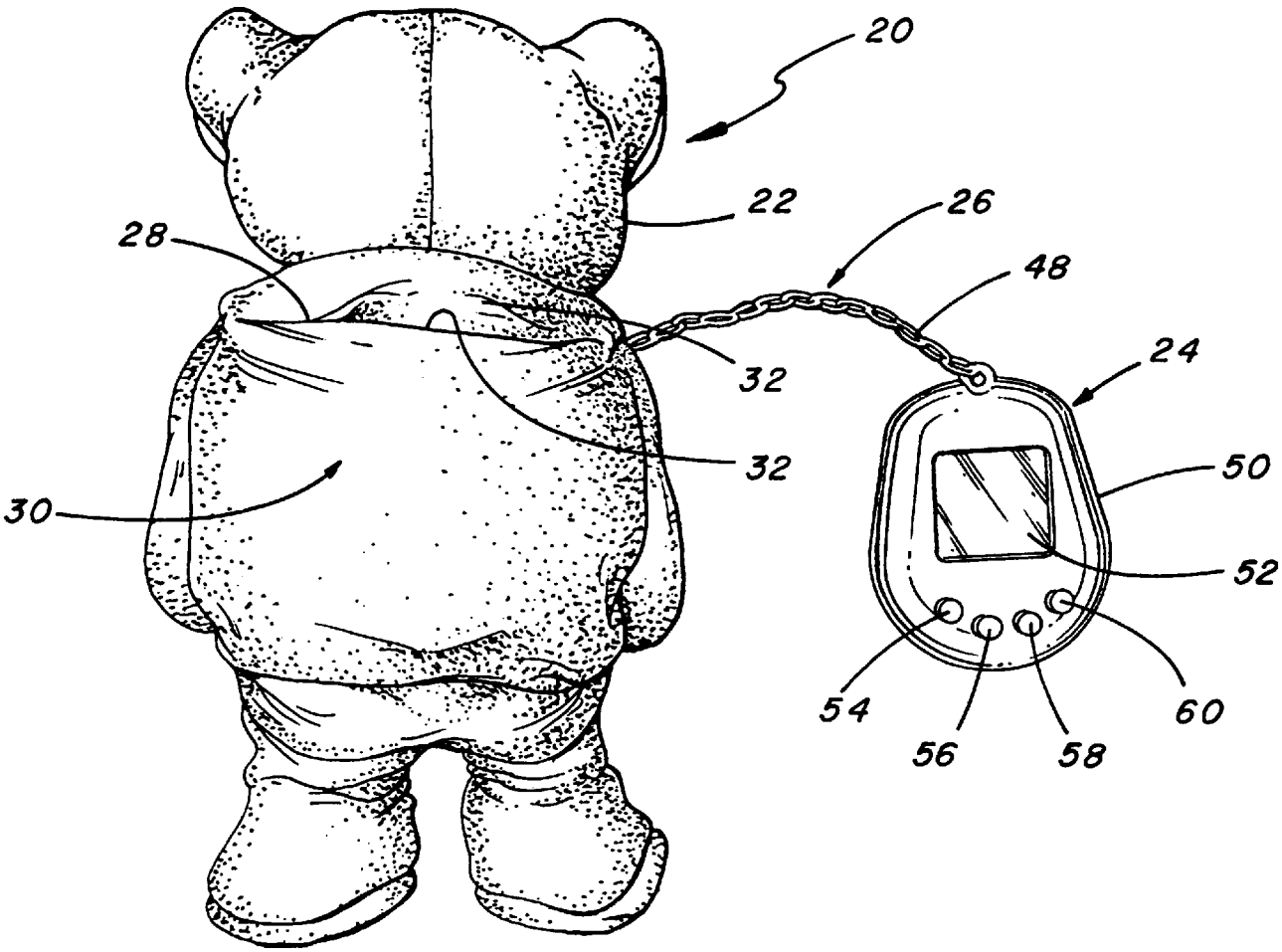
FIG. 3 is a rear view of the toy character of FIG. 1 with the electronic activities-oriented game unit withdrawn from the pouch.

An exemplary preferred toy apparatus 20 is shown in FIGS. 1–3. The toy apparatus includes a toy character 22, a game unit 24 and a tether 26. In the illustrated embodiment, the toy character is a toy bear. However, the scope of the present invention additionally contemplates other toy characters including but not limited to those illustrated in FIGS. 5–9.

Referring to FIGS. 2 and 3, the game unit 24 comprises an electronic game, preferably but not necessarily an electronic activities-oriented game, sized to fit within a pouch 28 formed on a backside 30 of the toy character 22. The pouch 28 preferably includes a sealable opening with fastening strips 32 including complementary hook and loop members such as Velcro®. Although the pouch 28 is shown on the backside 30 of the toy character 22, it should be appreciated that the pouch 28 can be located on a different portion of the toy character 22 as desired and as is practical depending upon the nature, size and shape of the toy character 22. Furthermore, the pouch 28 can simply be an opening or aperture in the toy character 22, rather than a pocket, with the game unit 24 being sized to be fitted within the opening or aperture.

As shown in FIG. 1, the toy character 22 includes a loop 34 formed on an exterior front surface 36 of the toy character 22. An exemplary loop 34 comprises nylon thread. The tether 26, in turn, includes a mechanism for detachably securing the game unit 24 to the toy character 22. An exemplary securing mechanism includes a hook 38 sized to fit through the loop 34, a post 40 and a latch mechanism 42. The hook 38 is attached to the post 40; and the latch mechanism 42 is fitted and spring-loaded within the post 40 to extend from the post 40 to an end portion 44 of the hook 38. The latch mechanism 42 includes a tab portion 46 which extends from a slot formed along the post 40. The tab portion 46 is employed to slide the latch mechanism 42 into the post 40 so that the hook 38 can be separated from the loop 34. The tether 26 additionally includes a chain 48 to which the post 40 and the game unit 24 are attached on opposing ends of the chain 48 as shown in FIGS. 1 and 3, respectively. It should be understood that other mechanisms for detachably securing the game unit 24 to the toy character 22 are contemplated as being within the scope of the present invention.

As shown in FIG. 3, the game unit 24 includes a housing 50, conventional programmable electronics (not shown) within the housing 50, a visual display 52, and player input mechanisms 54 (L), 56 (Enter), 58 (R), and 60 (Mode/Cancel). The housing 50 is preferably formed of a light-weight, non-toxic plastic material. The visual display 52 comprises, for example, a liquid crystal display with display elements that are activated and deactivated under control of the electronics within the housing 50. The player input mechanisms 54, 56, 58, 60 preferably comprise buttons positioned as shown on the housing 50 adjacent the visual display 52. The buttons are electrically connected to the electronics within the housing 50 and provide switch-style (i.e., ON/OFF, HI/LO) input signals to the electronics.

Generally, the game unit 24 is programmed to display images to a player of the game unit 24 at the visual display 52. As shown in FIG. 4B, the game unit 24 is preferably programmed to generate visual images of a virtual toy character 62 corresponding to the toy character 22. In the exemplary preferred embodiment, the virtual toy character 62 is a bear.

In a preferred embodiment, the game unit 24 is also programmed to store and adjust attributes of the virtual toy character 62 in response to player inputs provided via the player input mechanisms 54, 56, 58, 60 and in response to a passage of time. The attributes of the virtual toy character include a state of hunger, state of happiness, and a state of discipline. Inputs provided by the player and the passage of time determine values of these attributes.

Figure 4A:
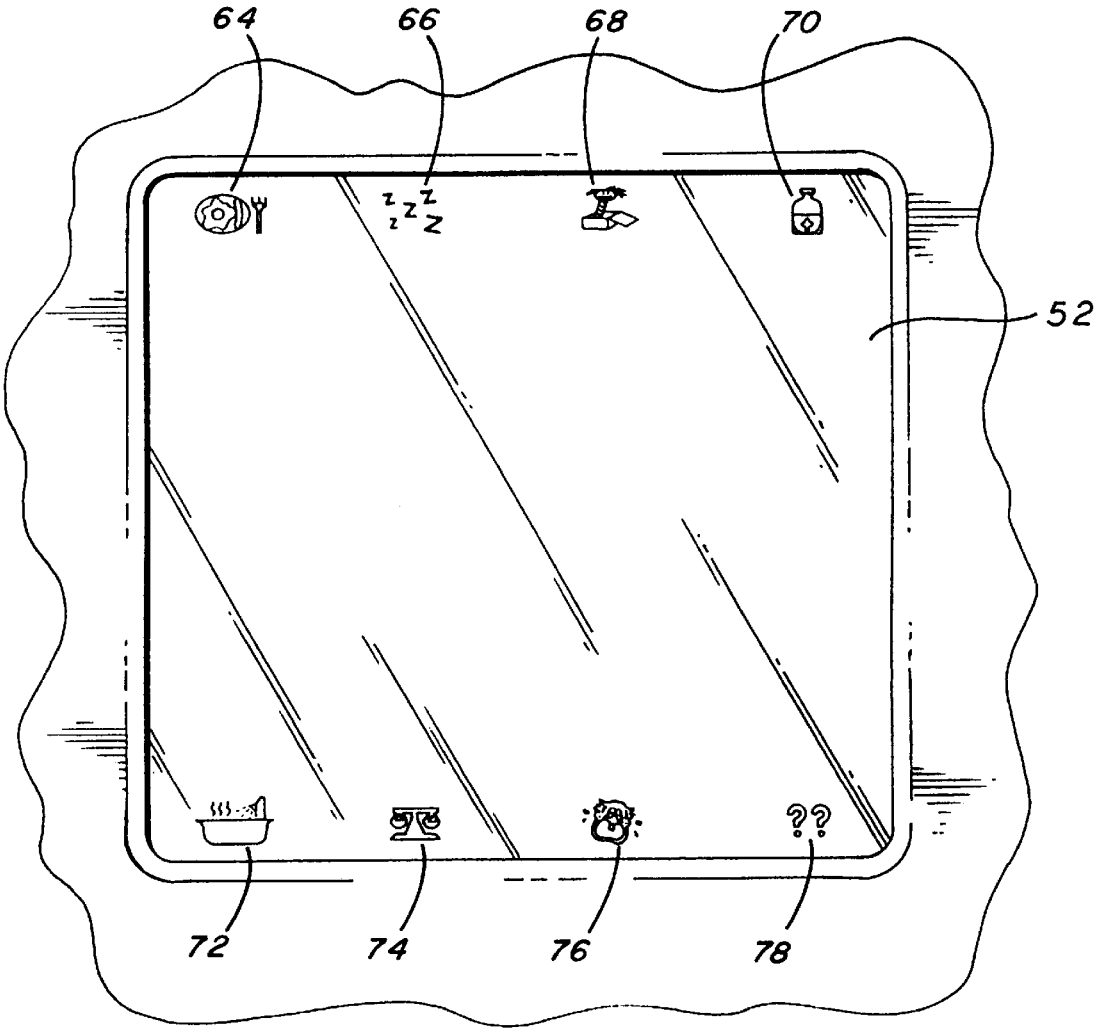
FIG. 4A is an enlarged view of a visual display of the game unit of FIG. 3 showing activity and status icons which are delectable by a player of the game unit.
Figure 4D:
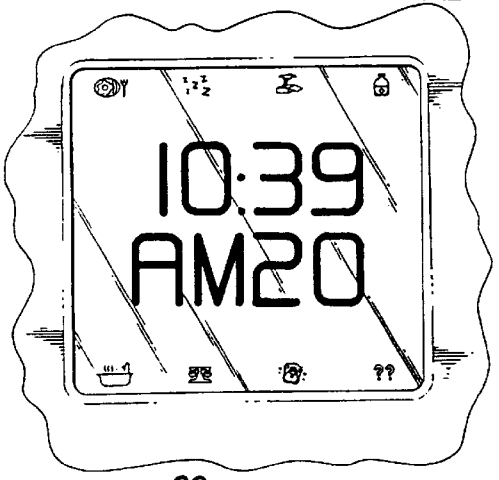
FIGS. 4B–4M show the visual display of FIG. 4A during various stages of an interactive game pertaining to a virtual toy character.

As best shown in FIG. 4A, a preferred embodiment of the game unit 24 is programmed to generate a plurality of icons at the visual display 52. Generally, the icons provide a visual representation of an activity relating to the virtual toy character 62 or pertain to a status of an attribute of the virtual toy character 62. In the illustrated preferred embodiment, the icons include a feeding icon 64, sleeping icon 66, playing icon 68, medical treatment icon 70, cleaning icon 72, health index icon 74, discipline icon 76, and hint icon 78 positioned within the visual display 52 as shown. It should be understood that the appearance, selection and positioning of these icons can be changed to accommodate changes in the programming of the game unit 24.

The player inputs are provided via the player input mechanisms 54, 56, 58, 60. The button 56 (Enter) is pressed to activate an icon. The buttons 54 (L) and 58 (R) are pressed to sequentially illuminate the icons 64, 66, 68, 70, 72, 74, 76. The button 60 (Mode/Cancel) is pressed to set/check the real time or to quit an activity.

Figure 4C:
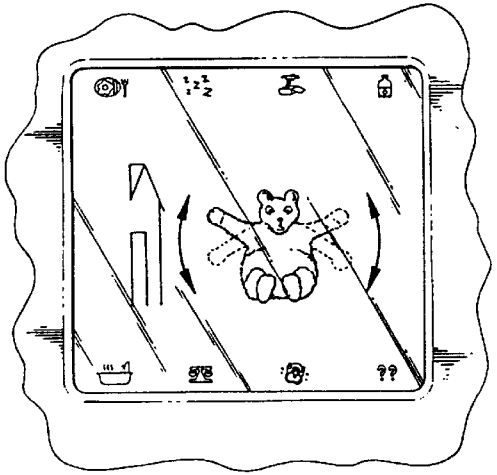
Figure 4B:
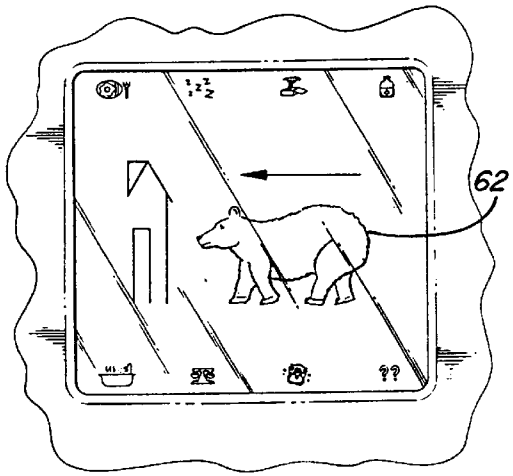

In operation, an activities-oriented game is activated by pressing a "reset" button (not shown) on the back side of the game unit 24. As shown in FIG. 4B, after the game is started, the virtual toy character 62 walks across the visual display 52 and is brought home in, for example, 20 seconds. The game unit 24 is programmed to present a variety of visual displays such as the one shown in FIG. 4C which show the virtual toy character 62 playing after it is brought home.

After the virtual toy character 62 is brought home, the player sets the real time clock included within the electronics by pressing the button 60 (Mode/Cancel) to enter the Enter Real Time Mode. Next, the button 56 (Enter) is pressed for a predetermined amount of time, e.g., at least 1.5 seconds, to enter a Time Setting Mode. The game unit 24 is programmed to advance the hour digits and the minute digits shown in FIG. 4D when the buttons 54 (L) and 58 (R) are pressed, respectively. The button 56 (Enter) is pressed again once the correct time is entered to confirm the setting. Next, the button 60 (Mode/Cancel) is pressed to return to the game screen.

The activities-oriented game is designed to encourage the player to take care of the virtual toy character 62 by: feeding the virtual toy character 62; turning on and off the lights so the virtual toy character 62 can sleep properly at night time; playing with the virtual toy character 62; providing medical treatment to the virtual toy character 62 when it gets sick; cleaning the virtual toy character 62 when it gets dirty; and disciplining the virtual toy character 62. The player of the game unit 24 initiates the aforementioned activities by activating the feeding icon 64, sleeping icon 66, playing icon 68, medical treatment icon 70, cleaning icon 72, and discipline icon 76, respectively.

To check the status of the health of the virtual toy character 62, the health index icon 74 is selected by the player. First, the player presses the button 56 (Enter). Next, the player presses the button 58 (R) five times to sequentially cycle through the icons 66, 68, 70, and 72 to stop at and illuminate the health index icon 74 as shown in FIG. 4K. The age (e.g., 4 YR) and weight (e.g., 229 lbs.) of the virtual toy character 62 are shown in FIG. 4K. In order to see the state of hunger, state of happiness, and state of discipline of the virtual toy character 62, the player employs either button 54 (L) or 58 (R) to cycle forward or backward through a sequence of visual displays such as the one shown in FIG. 4L which shows a happiness bar graph 80 beginning at a low happiness side 82 and ending at a high happiness side 84. A happiness region 86 is shown darkened in and indicates the state of happiness of the virtual toy character 62. The word "HAPPINESS" is also shown above the happiness bar graph 80 and, in a preferred embodiment, moves across the visual display 152 as shown by arrow 88. Similar visual displays are presented to the player to show the state of hunger and the state of discipline of the virtual toy character 62.

The game unit 24 is programmed such that the development and life span of the virtual toy character 62 depend upon how it is cared for by the player. The virtual toy character 62 sleeps during a predetermined time interval such as between 11:00 p.m. and 7:00 a.m. During this sleep interval, the virtual toy character 62 cannot be feed or played with, but it can be disciplined. If the state of discipline of the virtual toy character 62 drops below a predetermined threshold, the virtual toy character 62 will refuse to eat or play until it is disciplined by the player.

The game unit 24 is also programmed to determined when the virtual toy character 62 defecates, hereinafter "dumps", in consideration of the real time and how much the virtual toy character 62 has been fed. If the dump is not cleaned up within a predetermined amount of time, the virtual toy character 62 gets sick. When ill, the virtual toy character 62 will eat, but will not play. If the virtual toy character 62 is allowed to get sick too often, is not fed enough, is not played with enough, or is disciplined too little or too much, it will grow up and be shown in a less healthy or less attractive image or, in some instances, die of bad health, rather than from old age. In an exemplary preferred embodiment, the life span of a properly cared for virtual toy character 62 is nine days. Events, suggested action, and possible result (if no action is taken by the player) are shown in the table below:

| Event | Suggested Action | Possible Result (If take no action) |
|---|---|---|
| Sick | Medical treatment | Death |
| Dump is generated | Cleaning | Sick |
| Sleeping | Turn off the light | Sick |
| Low Hunger Index | Feeding | Sick |
| Low Discipline Index | Discipline Action | Refuse to do anything |
| Low Happiness Index | Game Playing | Unhappy |

To feed the virtual toy character 62, the feeding icon 64 is selected by pressing the button 56 (Enter). The display shown in FIG. 4E is thereafter presented to the player. In the exemplary preferred embodiment, the player is presented with a choice of foods 90, 92. The triangle 94 is shown pointing at the food 92. The player toggles back and forth between the foods 90, 92 with the button 54 (L) and the button 56 (R). As shown in FIG. 4E, the triangle 94 switches the direction (left or right) in which it is pointed depending upon which button was most recently pressed. Once a food is selected, the player presses the button 56 (Enter) again to feed the virtual toy character 62. A visual display such as that shown in FIG. 4F is thereafter presented to the player. Preferably, the game unit 24 is programmed such that the mouth of the virtual toy character 62 opens and closes and pieces of the food 90 gradually disappear until the food 90 vanishes entirely from the visual display 52. The more the virtual toy character 62 is fed, the more the state of hunger improves, i.e., the virtual toy character 62 becomes less hungry. When the player no longer wishes to feed the virtual toy character 62, the button 60 (Mode/Cancel) is pressed to deactivate the feeding icon 64.

Figure 4G:
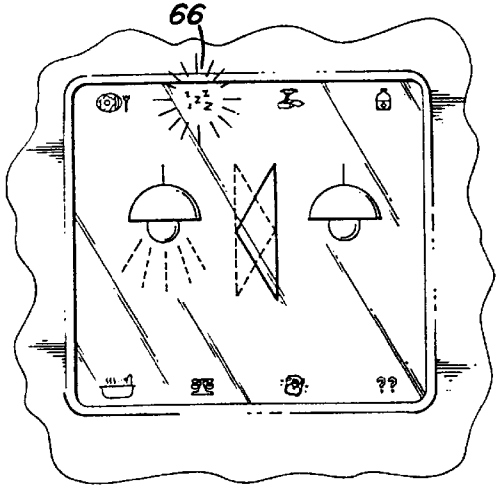
Figure 4F:
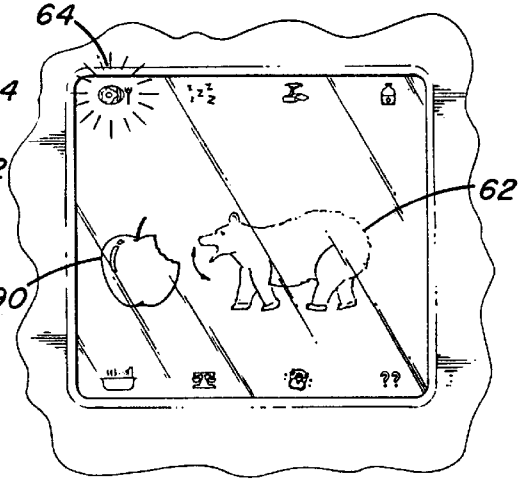
Figure 4E:
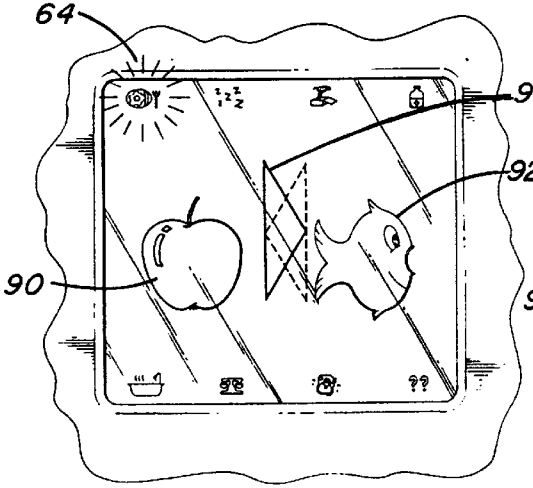
Figure 4J:
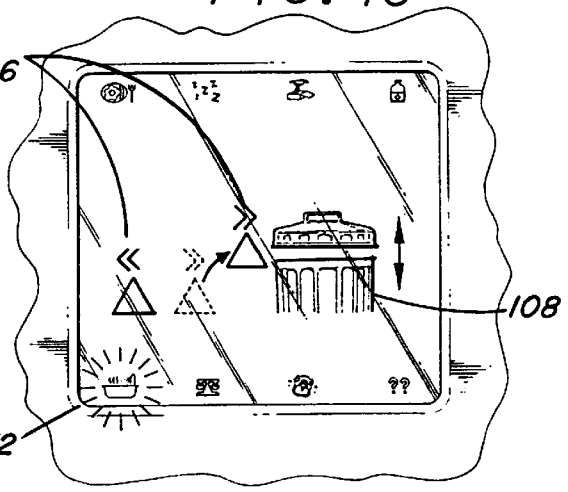
Figure 4M:
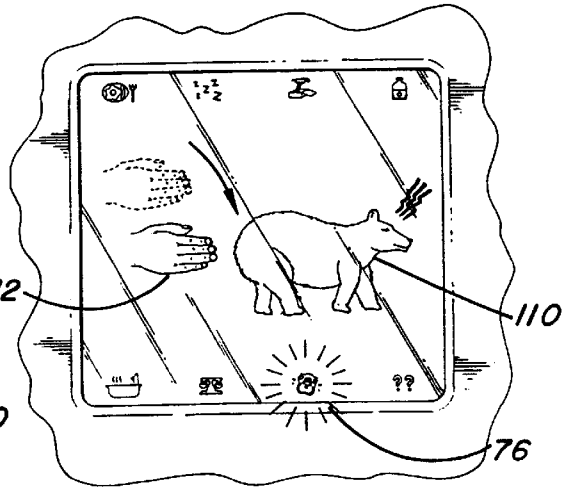
Figure 4I:
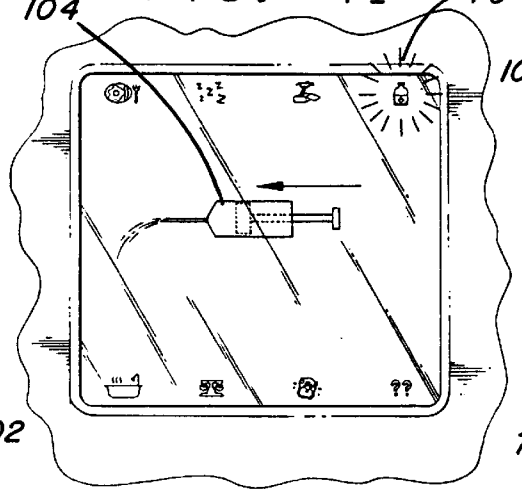
Figure 4L:
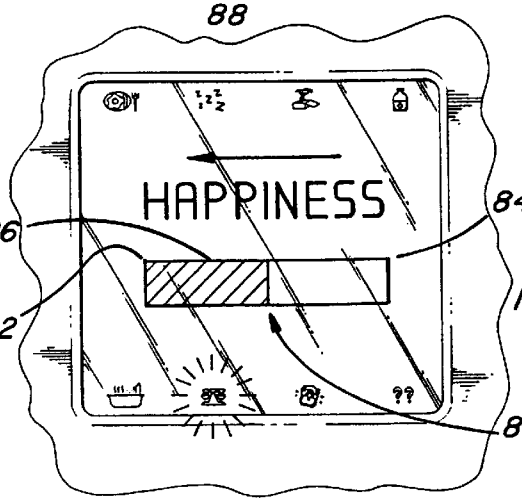

A display such as that shown in FIG. 4G is presented after the sleeping icon 66 is activated. The display includes a "lights on" symbol 96, "lights off" symbol 98, and a triangle 100. The player toggles back and forth between the "lights on" symbol 96 and the "lights off" symbol 98 with the button 54 (L) and the button 56 (R). As shown in FIG. 4G, the triangle 100 switches the direction (left or right) in which it is pointed depending upon which button was most recently pressed. Once one of the symbols 96, 98 is selected, the player presses the button 56 (Enter) again to turn the lights on or off. When the player is satisfied with the condition of illumination, the button 60 (Mode/Cancel) is pressed to deactivate the sleeping icon 66.

Figure 4H:
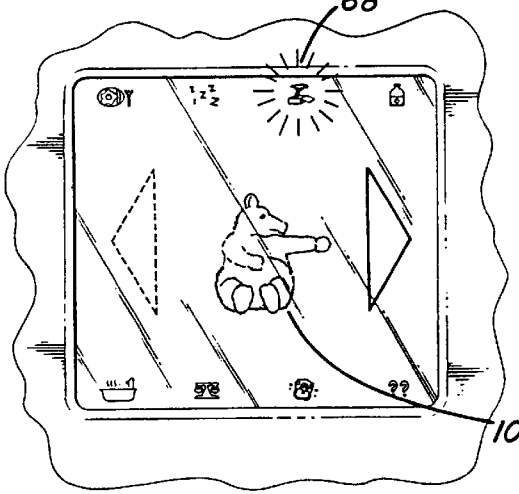
Figure 4K:
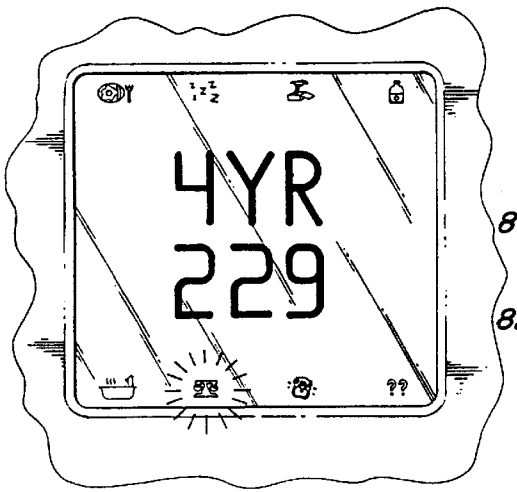

A display such as that shown in FIG. 4H is presented after the playing icon 68 is activated. The display includes a playing image 102 of the virtual toy character 62 that alternately points to the left or to the right. According to an exemplary preferred activities-oriented game, the player is given a predetermined amount of time to guess, by employing either the button 54 (L) or the button 56 (R), which direction the virtual toy character 62 is going to go. If the player guesses correctly, e.g., at least 3 out of 5 times, the virtual toy character 62 will be happier and the state of happiness will improve. When the player no longer wishes to play with the virtual toy character 62, the button 60 (Mode/Cancel) is pressed to deactivate the playing icon 68. It should be understood that the scope of the present invention contemplates that the game unit 24 could alternately be programmed to present a different type of game and/or a choice of games to the player upon activation of the playing icon 68.

After the medical treatment icon 70 is activated (and only when the virtual toy character 62 is sick), the player is presented with a display such as that shown in FIG. 4I showing a syringe 104 dispensing medicine.

After the cleaning icon 72 is activated (and only when the virtual toy character 62 has dumped), the player is presented with a display such as that shown in FIG. 4J showing dumps 106 being moved into a trash can 108.

A display such as that shown in FIG. 4M is presented after the discipline icon 76 is activated. The display includes a cringing image 110 of the virtual toy character 62 and a hand 112 that moves toward the cringing image 110 as shown to administer discipline through corporal punishment. As the virtual toy character 62 is punished more, the state of discipline improves. However, in a preferred embodiment, the virtual toy character 62 will die if the state of discipline exceeds a predetermined threshold. When the player no longer wishes to discipline the virtual toy character 62, the button 60 (Mode/Cancel) is pressed to deactivate the discipline icon 76.

In a preferred embodiment, the hint icon 78 (best shown in FIG. 4A) is illuminated when the virtual toy character 62 has become sick or when a dump needs to be cleaned up. The game unit 24 can also be programmed to provide the player with hints about other events or statuses of the virtual toy character 62.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

I claim:

1. A toy apparatus comprising:

a toy character including a pouch with a sealable opening;

an activities-oriented game unit programmed to display images to a player of said game unit, said game unit being sized to fit within said pouch; and a mechanism for detachably securing said game unit to said toy character.

2. The toy apparatus of claim 1 wherein:

said toy character includes a loop formed on an exterior surface of said toy character; and said securing mechanism comprises a hook sized to fit through said loop.

3. The toy apparatus of claim 2 wherein:

said securing mechanism further comprises a post portion to which said hook is attached and a latch mechanism adapted to extend from said post portion to an end of said hook.

4. The toy apparatus of claim 1 wherein:

said sealable opening comprises fastening strips with complementary hook and loop members.

5. The toy apparatus of claim 1 wherein:

said game unit is programmed to generate visible images of a virtual toy character corresponding to said toy character.

6. The toy apparatus of claim 5 wherein:

said game unit is programmed to store and adjust attributes of said virtual toy character in response to player inputs.

7. The toy apparatus of claim 6 wherein:

said player inputs pertain to a plurality of activities involving said virtual toy character.

8. The toy apparatus of claim 6 wherein:

said game unit is programmed to adjust said attributes of said virtual toy character in response to a passage of time.

9. The toy apparatus of claim 5 wherein:

said game unit further includes a visual display at which said visible image is presented to a player of said game unit.

10. The toy apparatus of claim 9 wherein:

said game unit is programmed to display a plurality of icons at said visual display.

11. The toy apparatus of claim 10 wherein:

said game unit further includes player input mechanisms configured to facilitate a selection of one of said icons by the player.

12. The toy apparatus of claim 10 wherein:

at least one of said icons is an activity icon providing a visual representation of an activity; and said game unit is programmed to provide, in response to a selection of said activity icon, an interactive interface at said visual display prompting the player to participate in said activity with said virtual toy character.

13. The toy apparatus of claim 10 wherein:

at least one of said icons is a status icon; and said game unit is programmed to provide a visual indication at said visual display of a status of an attribute of said virtual toy character.

14. A toy apparatus comprising:

a toy character with a receptacle;

an activities-oriented game unit programmed to provide images of said toy character to a player of said game unit, said game unit being sized to fit within said receptacle; and a tether adapted to secure said game unit to said toy character.

15. The toy apparatus of claim 14 wherein:

said receptacle is a pouch formed on a back side of said toy character.

16. The toy apparatus of claim 14 wherein:

said receptacle includes an opening portion with hook and loop members positioned in a complementary manner at said opening portion.

17. The toy apparatus of claim 14 wherein:

said tether comprises a chain.

* * * * *